US006402114B1

(12) United States Patent
Carnahan et al.

(10) Patent No.: US 6,402,114 B1
(45) Date of Patent: Jun. 11, 2002

(54) SLIDING AND SWIVELING DEVICE

(76) Inventors: Garnett Carnahan; Caroline Carnahan, both of 337 E. Lindbergh, Nixa, MO (US) 65714

( * ) Notice: Subject to any disclaimer, the term of this patent is extended or adjusted under 35 U.S.C. 154(b) by 0 days.

(21) Appl. No.: 09/506,904

(22) Filed: Feb. 18, 2000

(30) Foreign Application Priority Data

Apr. 8, 1999 (CN) ..... 99226210 U

(51) Int. Cl.[7] ..... F16M 13/00; A47C 1/02
(52) U.S. Cl. ..... 248/425; 297/344.24
(58) Field of Search ..... 248/416, 425, 248/429; 297/344.24, 344.26, 344.22

(56) References Cited

U.S. PATENT DOCUMENTS 2,290,464 A * 7/1942 Buchheit
3,542,326 A * 11/1970 Reapsummer
5,720,462 A * 11/1970 Brodersen
5,131,718 A * 7/1992 Cooper
5,702,084 A * 12/1997 Carnahan et al.
5,704,729 A * 1/1998 Carnahan et al.

FOREIGN PATENT DOCUMENTS

CN 93109412 2/1995

* cited by examiner

*Primary Examiner*—Milton Nelson, Jr.
(74) *Attorney, Agent, or Firm*—Rabin & Berdo, P.C.

(57) ABSTRACT

A sliding and swiveling device includes a mounting plate, a moving seat, a moving assembly, and a rotating assembly. On the moving seat is provided an inner annular-toothed portion. The rotating assembly includes a fixedly toothed sleeve, a movably toothed ring, a first protruding strip, a camshaft, etc. In the toothed sleeve is provided an annular-toothed portion. On the toothed ring is provided an annular-toothed portion, and the upper surface thereof is provided a protruding pillar. The first protruding strip and camshaft are fitted on the mounting plate, which can be engaged each other or not. The mounting plate can freely rotate in twenty locking positions within 360 degrees around the toothed sleeve. Because the camshaft is also positioned on the mounting plate, the sliding and turning of the chair are both operated in the same place along with the movement thereof, thus it's convenient for users.

9 Claims, 4 Drawing Sheets

SLIDING AND SWIVELING DEVICE

FIELD OF THE INVENTION

The present invention relates to a chair device, particularly to a sliding and swiveling chair device which is operated with stable working performance.

BACKGROUND OF THE INVENTION

So far, the chair device capable of providing both forward-back movement and pivoted rotation is in combination with individually designed sliding device and rotating device, and usually an operating handle of sliding device is disposed on a mounting plate of the chair while an operating handle of rotating device is disposed on a certain fixed component thereof. During an operation, the relative position of the mounting plate and the sliding handle always fixed but not for the rotating handle. China patent No. 93109412.7 discloses a sliding and swiveling device including a base plate (mounting plate), a rotating, a sliding, a locking assemblies and a lockup handle component, wherein, both sides of the base plate are provided with a recess, and the rotating assembly includes a first and a second rotating members. The first rotating member has sliding feet fitted into the recesses and an annular body portion integrated with the sliding feet. On the annular body portion is provided an internal conical surface, an annular slot and a seat. The second rotating member has an annular body portion on which is provided an external conical surface, an annular slot and a sliding slot. The internal and external conical surfaces of the first and second rotating members are coincided together to form an annular hollow space for accommodating rotatable balls to lock both the rotating members. In addition, on the seat of first rotating member is mounted the lockup handle component interconnected to the sliding slot of second rotating member, which make the second rotating member capable of rotating and being locked with respect to the first rotating member. This device has the features of uniform stress force and stable lockup performance during rotation, however, due to the lockup handle component is fitted on the first rotating member, when the base plate moves back and forth, the position of lockup handle component relative to the base plate is changed all the time so that it is inconvenient for users to hold the lockup handle component. Moreover, the arrangement of the above-mentioned internal and external conical surfaces, annular slots and sliding slots of rotating assemblies are rather complicated in manufacturing to increase the cost.

SUMMARY OF THE INVENTION

The object of the present invention is to provide a sliding and swiveling chair device in follow-up operation able to dispose the operating handle of moving and rotating devices simultaneously on the mounting plate, during operating, no matter how the mounting plate or chair joined herewith moves or rotates, the operating handle will always remain in the original position of the mounting plate.

In order to realize the above-mentioned object, the technical scheme is as such: A rolling and swiveling chair device in follow-up operation comprises a mounting plate, end cover, support tube, moving seat, moving assembly and rotating assembly, wherein, said mounting plate is provided with symmetric sliding slots formed by bending it downward and inward at right angle on two opposite sides along its lengthwise direction.

Said end cover is fitted on one of the opposite two ends of the mounting plate in the lengthwise direction.

Said moving seat comprises an upper plate with opening and holding tube integrated into one and located under the upper plate, wherein, on the opening of said upper plate is provided an inner annular toothed portion with a series of rectangular teeth; the tube hole of said holding tube is in communication with upper plate opening, said moving seat can be movably inserted through the upper plate into the sliding slots of mounting plate to position the moving seat under the mounting plate;

The rotating assembly comprises a fixed toothed sleeve, a movable toothed ring, a first protruding strip, a cam shaft and 2–4 coil springs; wherein;

Said fixed toothed sleeve is a short sleeve with jacketed layer, on the inner peripheral face at its inner layer opening is provided an annular toothed portion with a series of straight teeth, on the inner peripheral face under the annular toothed portion is provided a protruding inner ring, and on the upper surface of that inner ring are provided 2–4 uniformly distributed cylinders stretching integrally; said fixed toothed sleeve can be rotatably inserted into the holding tube of moving seat;

Said movable toothed ring comprises an upper annular toothed portion located at the upper portion with several straight teeth on the outer peripheral face and a lower circular ring portion formed in an integral and located under the upper annular toothed portion on the upper surface of said upper annular toothed portion is provided a radial redial, in addition, on the bottom face of that recess is provided a long strip-shaped protruding pillar, said movable toothed ring is fitted in a position between the moving seat opening and fixed toothed sleeve opening;

Said coil springs are individually placed in the cylinders of fixed toothed sleeve, and located between the inner ring of fixed toothed sleeve and the bottom face of upper annular toothed portion of movable toothed ring.

Said first protruding strip is a long strip-shaped component with semi-circular slot, and disposed on the middle position of the rear face of mounting plate in lengthwise direction opposite to the recess of movable toothed ring in straight line.

Said cam shaft comprises a shalt lever, a handle fitted to one end of shaft lever with connecting rod, said shaft lever is provided with a right-angle slot on the outer peripheral face in the axial direction, said cam shaft is rotatably fitted in the first protruding strip through shaft lever , and under the action of coil springs to make its righ-tangle slot go into mesh with right-angle wall of protruding pillar one side of on the movable toothed ring bottom face, simultaneously to make the upper annular toothed portion of go into mesh with teeth of inner annular toothed portion of moving seat at the time of rotating of said cam shaft, the free end of one edge of right-angle slot on the cam shaft presses the protruding pillar downward and the movable toothed ring downward by a mode of releasing mesh with protruding pillar, and simultaneously makes teeth of toothed annular portion of the movable toothed ring go into mesh with teeth of the fixed toothed sleeve and moving seat.

As the above-mentioned swiveling chair device, wherein, the upper annular toothed portion of said movable toothed ring, the inner toothed portion of moving seat and the annular toothed portion of fixed toothed sleeve are provided each with 12 straight teeth.

As the above-mentioned swiveling chair device, wherein said moving seat on its upper surface is further provided with a row of protruding toothed portion with of teeth side having inclined face;

Said moving assembly comprises a second protruding strip, a tooth-shaped shaft and a tension spring, wherein, said second protruding strip is a long strip-shaped component with semi-circular slot, and is fitted on one side of the mounting plate in a mode parallel to the first protruding strip and making the protruding toothed portion of the moving seat and the second protruding strip opposed linearly;

Said tooth-shaped shaft comprises a shaft-shaped rack, a handle fitted with connecting rod to one end of the rack, on the outer peripheral face of said rack are provided an obtuse-angle slot portion in axial direction and a row of spacing teeth complementary in 180° with the slot portion, said tooth-shaped shaft is fitted in the second protruding strip through the shaft-shaped rack, the included angle of the slot portion is equal to that of tooth top face and tooth inclined face of moving seat protruding toothed portion, when the tooth-shaped shaft makes clockwise rotation, the rack and the tooth top face of all teeth of the protruding toothed portion of moving seat are located on a same plane, when in counterclockwise rotation, the rack and teeth of protruding toothed portion of moving seat go into mesh relatively;

One end of said tension spring is fixed on the handle of tooth-shaped shaft, its another end is fixed on the lower surface of mounting plate.

As the above-mentioned swiveling rotating chair device, wherein, the upper plate of four corners of said moving seat are provided each with a wheel frame portion, said moving seat comprises further four small wheels, these small wheels are individually rotatably fitted in the wheel frame of upper plate through wheel shaft said moving seat is movably inserted into the sliding slots of mounting plate by utilizing the four small wheels, so as to make the moving seat located under the mounting plate.

As the above-mentioned swiveling chair device, wherein, it comprises further a lockup hook, that lockup hook has a right-angle fitting portion located at the upper portion with hole, a clamping portion located at the lower portion in hook shape and a corrugated push-pull portion joining the fitting portion and clamping portion, the lockup hook is fixed on the moving seat via the fitting portion, so as to make the front end of its clamping portion tightly located at the lower end of moving seat and fixed toothed sleeve.

As the above-mentioned swiveling chair device, wherein, one end of said support tube can be located inside the fixed toothed sleeve in insert mode, and on the opposite walls of the support tube and fixed toothed sleeve are provided mutually matching concave and convex slots.

The present utility model is very distinct in advantage and effect as compared to the prior art, it is apparent from the above since the present utility model is composed of mounting plate, end cover, moving seat, moving assembly, rotating assembly, etc., wherein, on the moving seat are provided wheel frames and inner annular toothed portion, the rotating assembly comprises a fixed toothed sleeve, a movable toothed ring, a first protruding strip, a cam shaft and 4 coil springs, wherein, in the fixed toothed sleeve is provided the inner annual toothed portion ,the outer peripheral face of movable toothed ring is provided with an upper annular toothed portion and on the upper surface is provided a radial recess, in that recess there is a protruding pillar, the first protruding strip and cam shaft are fitted on the mounting plate and can act relatively with the protruding pillar, under the state of cam shaft and protruding pillar positioned in complementary meshing, the upper annular toothed portion of movable toothed ring is in mesh with the inner annular toothed portion on the moving seat, the mounting plate (moving seat) can rotate at random in 360° around the fixed toothed sleeve, also due to all annular toothed portions having equal number of teeth, hence the mounting plate can selectively rotate a certain angle and be positioned and locked. When operating the handle of cam shaft making the cam shaft rotate to the position of top end of protruding where the protruding pillar in out of mesh, and tinder the condition of pushing the movable toothed ring to move it downward, the upper annular toothed portion of movable toothed ring can be made to go into mesh simultaneously with the inner annular toothed portion of moving seat and the annular toothed portion of fixed toothed sleeve, then the mounting plate (including the moving seat) can not rotate around fixed toothed sleeve, i.e. being kept still, therefore regardless of moving or rotating the mounting plate of rolling and swiveling chair device, the operator can at the original position of chair operate at will or in follow-up operation the handle of upper tooth-shape shaft and cam shaft on the mounting plate, i.e. the operating position always remains unchangeable, so as to bring enormous convenience to the user. Moreover, the present utility model has been made with overall improvement in arrangement to achieve rational design, compact structure, stable performance, little noise, and being able to save raw material and reduce production cost.

DETAILED DESCRIPTION OF THE INVENTION

Figure 1:
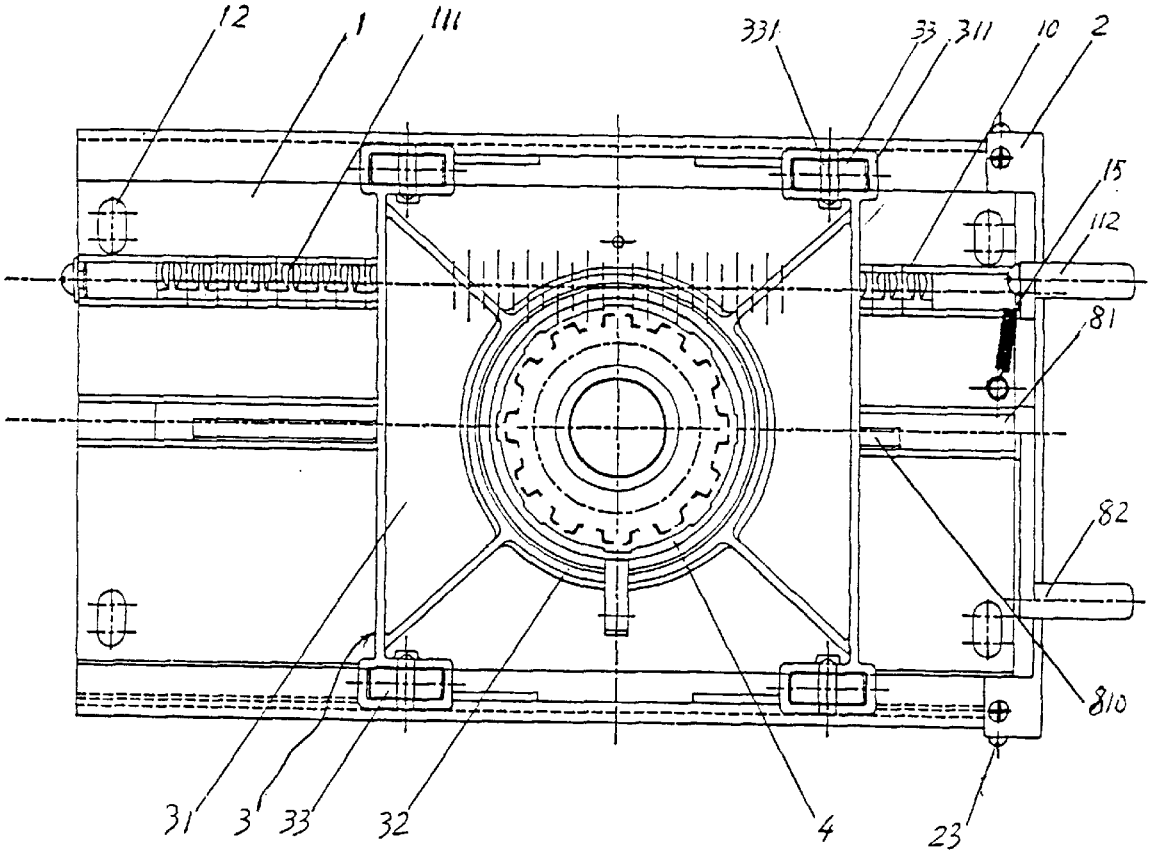
FIG. 1 is a schematic front view of the present invention.
Figure 2:
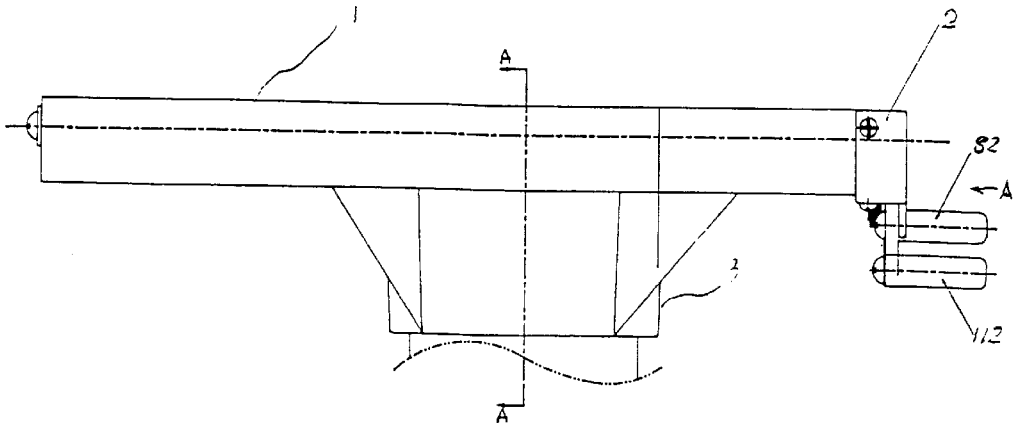
FIG. 2 is a vertical view of FIG. 1.
Figure 3:
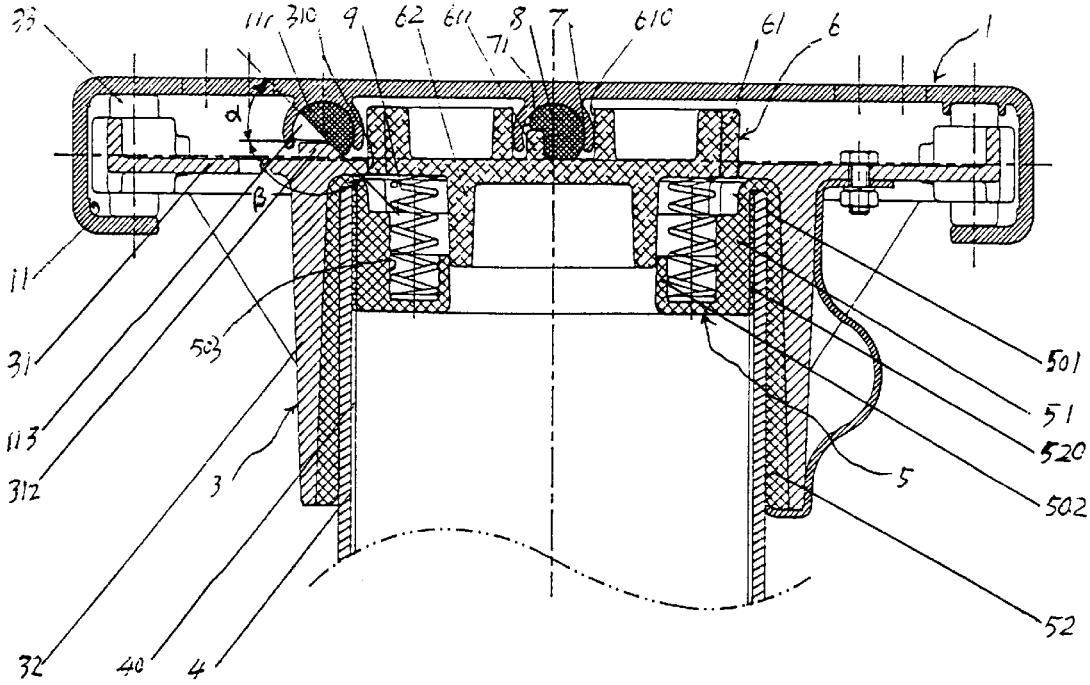
FIG. 3 is a first one of sectional views made along line A—A in FIG. 2, showing the protruding toothed portions of the tooth-shaped shaft and moving seat being positioned at releasing of mesh, also the cam shaft and protruding pillar of the movable toothed ring being positioned in mesh in an individually opened state.

Referring to FIGS. 1, 2 and 3, a sliding and swiveling device comprises a mounting plate 1, an end cover 2, a moving seat 3, a support tube 4, a moving assembly and a rotating assembly. The mounting plate 1 is rectangular and provided with two symmetric sliding slots 11 formed by bending the lengthwise edges thereof downward and inward both in a right angle. On four corners of the mounting plate 1 are each provided a mounting hole 12 for mounting an chair (not shown) thereon, and screw holes arc provided at the plate surface and bending edge of one sliding slot 11.

The end cover 2 with a cap-shaped is mounted on one side of the mounting plate 1 by screws 23.

The moving seat 3 comprises an upper plate 31 with a hole in the middle, a holding tube 32 and four small wheels 33. The upper plate 31 is square or rectangular in shape. On the wall of the middle hole of upper plate 31 can be provided an annular-toothed portion 310 with rectangular teeth or straight teeth; in this preferred embodiment, the number of teeth of annular-toothed portion 310 is twelve. On four corners of the upper plate 31 are each provided a wheel frame portion 311. The holding tube 32 is integrally formed with and located under the upper plate 31, and is connected to the middle hole of upper plate 31. The four small wheels 33 can be rotatably fitted in the four wheel frames 3 11 of upper plate 31 through wheel shafts 331 respectively. The moving seat 3 therefore is moveably mounted under the mounting plate 1 by positioning four small wheels 33 into the sliding slots 11. In the present invention, a rolling contact of small wheels 33 with the sliding slots 11 supports the mounting plate 1 to move forward and backward in less friction and more ease operation, particularly the small wheels 33 can be made of high-strength nylon to further reduce noise in use.

Figure 4:
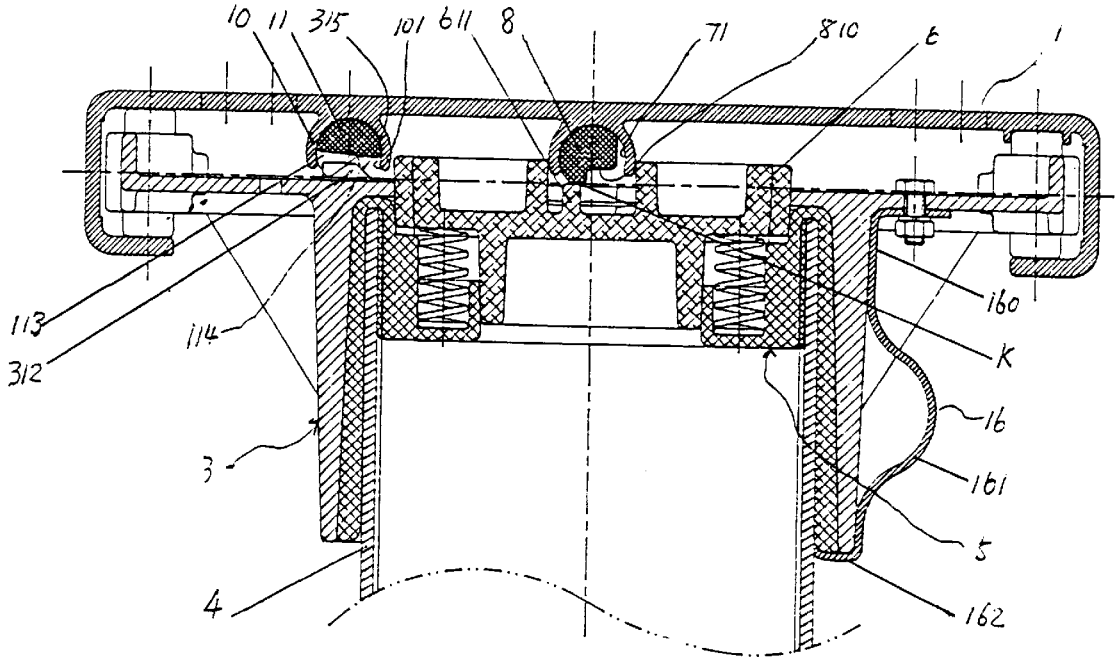
FIG. 4 is a second one of sectional views made along line A—A in FIG. 2, showing the protruding toothed portions of the tooth-shaped shaft and moving seat being positioned in mesh also the protruding pillar of the cam shaft and the movable toothed ring being positioned at releasing or mesh in an individually locked state.
Figure 5:
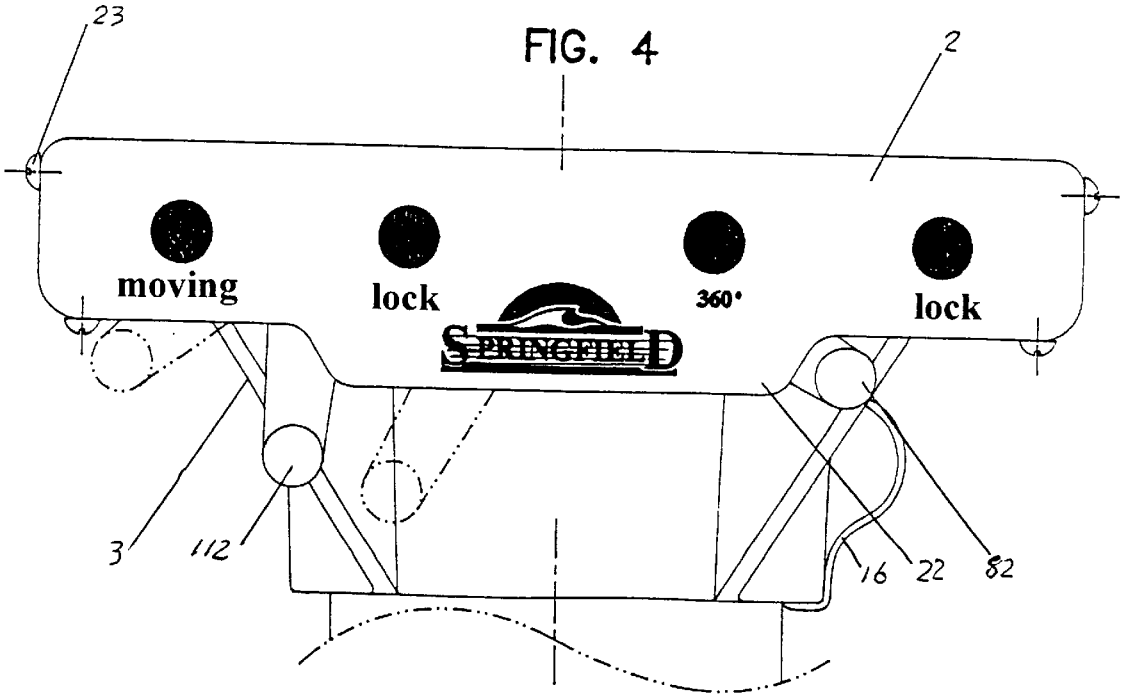
FIG. 5 is a view from A—A in FIG. 2 showing the view of operation label of all handles visible from the front surface of the end cover.
Figure 6:
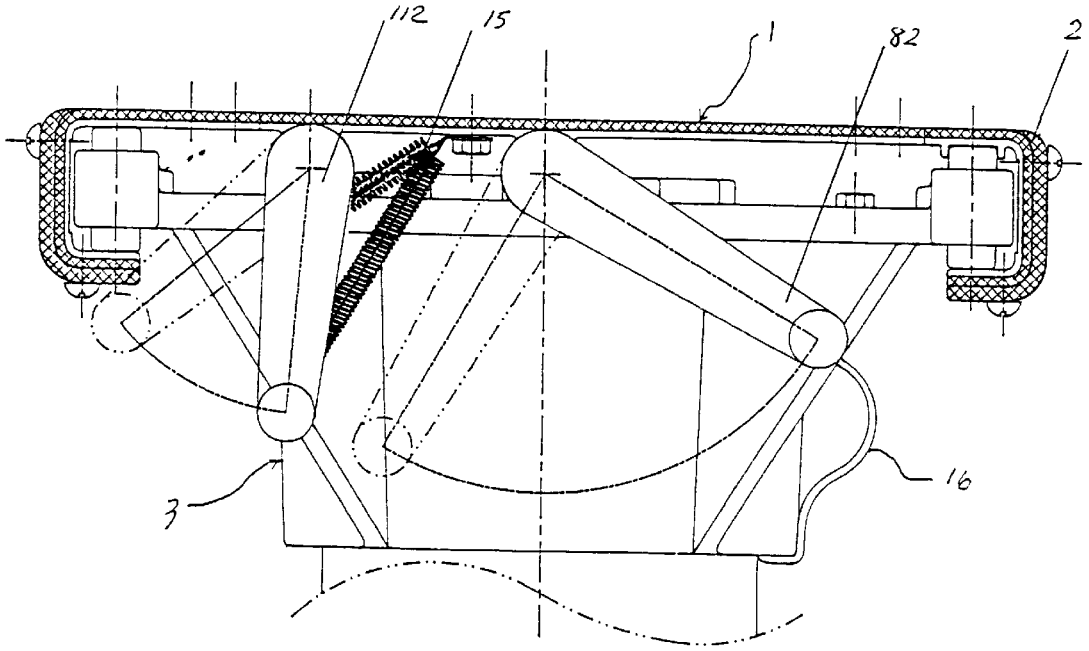
FIG. 6 is a view showing change of all handle operating positions visible after removing the front portion of mounting plate.

Referring to FIGS. 3 and 4, the rotating assembly comprises a fixedly toothed sleeve 5, a movably toothed ring 6, a first protruding strip 7, a camshaft 8 and four coil springs 9. The toothed sleeve 5 is made of nylon and has a short inner layer 51 and a long outer layer 52 formed integrally. There is provided an annual-toothed portion 501 with rectangular teeth or straight teeth on the inner surface of upper opening of inner layer 51. In the preferred embodiment, the number of teeth of annular-toothed portion 501 is twelve. On the inner surface of lower opening of inner layer 51 is provided an inner ring 502, and on the outer surface thereof is provided several axially and uniformly distributed recesses 520. On the upper surface of the inner ring 502 is provided four uniformly distributed cylinders 503 formed individually with an upward opening. The toothed sleeve 5 can be rotatably inserted into the holding tube 32 of moving seat 3 through the outer layer 52. In addition, the lower ends of outer layer 52 and holding tube 32 are usually designed to keep in the same length after assembling.

The support tube 4 is usually made of aluminum alloy. On its inner wall is provided some protruding slots 40 axially and uniformly distributed thereon. The support tube 4 can be inserted into the layer between the inner layer 51 and the outer layer 52 of the toothed sleeve 5, and is engaged with the recesses 520 by the protruding slots 40 to fix the toothed sleeve 5 from rotation with respect to the support tube 4.

The toothed ring 6 is made of plastics, and comprises an upper annular-toothed portion 61 with twelve straight teeth on the outer surface, and a lower annular portion 62 of relatively smaller diameter formed integrally and located under the upper annular-toothed portion 61. On the upper surface of upper annular-toothed portion 61 is provided a radially distributed recess 610. In addition, on the bottom surface of the recess 610 is provided a long strip-shaped protruding pillar 611 in the lengthwise direction. The toothed ring 6 is fitted in the upper opening position between the moving seat 3 and the toothed sleeve 5, and can make the lower annular portion 62 movably engaged with the inner ring 502 of inner layer 51.

The four coil springs 9 are individually located in the cylinders 503 of toothed sleeve 5 and specifically are located between the cylinders 503 and the bottom surface of upper annular-toothed portion 61 of toothed portion 6. The toothed ring 6 is always lifted upward under a normal condition of the coil springs 9.

The first protruding strip 7 is a long strip-shaped component with a semi-circular slot 71 and is longitudinally disposed in a middle position of the rear surface of mounting plate 1. Most parts of the first protruding strip 7 can be inserted into the recess 610 of toothed ring 6.

The camshaft 8 comprises a shaft lever 81 and a handle 82. The handle with a connecting rod is fitted to one end of the shaft lever 81. The shaft lever 81 is provided with a right-angle slot 810 tangent to the axially outer periphery thereof. The camshaft 8 can be rotatably fitted in the first protruding strip 7 through the shaft lever 81, and can make the connecting rod of handle 82 lean closely against the inner surface of end cover 2 and the other free end of handle 82 stretch out of the end cover 2 to be positioned at one side of a protruding portion 22 of end cover 2. The right-angle slot 810 of shaft lever 81 under the stretch of coil springs 9 is engaged with the respective right-angle walls at both sides of protruding pillar 611. That is, from the transverse cross-section view of camshaft 8, the narrower edge of right-angle slot 810 is located on the top surface and the wider edge leans closely against one side of that protruding pillar 611. Under the engagement between the right-angle slot 810 on the camshaft 8 and the protruding pillar 611 of toothed ring 6, the upper annular-toothed portion 61 is merely engaged with the inner annular-toothed portion 310 of moving seat 3. Consequently, the mounting plate 1 or the chair mounted thereon can rotate freely to any position within 360 degrees with respect to the fixedly toothed sleeve 5 as shown in FIG. 3. When pushing the handle 82 to make the camshaft 8 rotate, the right-angle slot 810 of camshaft slowly rotates till not engaged with the protruding pillar 611, and a free end K of narrow edge of the slot 810 is contacted to the top surface of protruding pillar 611 to press down the toothed ring 6 till the straight teeth of upper annular-toothed portion 61 are engaged with both the inner toothed portion 310 of moving seat 3 and the straight teeth of annular toothed portion 501 of toothed sleeve 5. The mounting plate 1 can not rotate with respect to the toothed sleeve 5, i.e. under a lock state as shown in FIG. 4. In practical operation, the mounting plate 1 can change from a regular locking state to a free rotating state through camshaft 8, however, it can also change from the regular locking state to a selecting angle. This is because the upper annular-toothed portion 61 of toothed ring 6, the inner toothed portion 310 of moving seat 3 and the annular-toothed portion 501 of toothed sleeve 5 are all with twelve teeth. When the toothed ring 6 rotates in one tooth to engage with the toothed sleeve again, the mounting plate 1 will turn 30 degrees. When rotates two, turns 60 degrees and so forth. That is, it is feasible to selectively have twelve set-up positions to lock within 360 degrees. On the other hand, since the moving seat 3 is made of aluminum alloy and the toothed sleeve is made of nylon, the free rotation of mounting plate 1 with respect to the toothed sleeve 5 is not only easy in rotation with little noise, but also with high reliability.

Referring to FIGS. 1 and 3 to 6, on the upper surface of moving, seat 3 is further provided a series of sector-shaped toothed components 312 in a linear arrangement, the inner toothed sides thereof individually have an inclined surface 315.

The moving assembly comprises a second protruding strip 10, a tooth-shaped shaft 11 and a tensible spring 15, wherein the second protruding strip 10 is the same as the first protruding strip 7 being a long strip-shaped component with a semi-circular slot 101, and is fitted on a left side or right side of the rear surface of mounting plate 1, parallel to the first protruding strip 7.

The tooth-shaped shaft 11 comprises a shaft-shaped rack 111 and a handle 112 fitted to one end of the rack 111 with a connecting rod. On the peripheral surface of rack 11 is provided a series of sector-shaped teeth 113 axially arranged and an aligned slot portion 114 located at one side (outer peripheral surface) of sector-shaped teeth 113. The positioned angle of sector-shaped teeth 113 is and the angle of slot portion 114 is. Usually is an acute angle, and is an obtuse angle. They are complementary into 180 degrees. The tooth-shaped shaft 11 of second protruding strip 10 is rotatably fitted in the semi-circular slot 101 through the shaft-shaped rack 111. It makes the connecting rod of handle 112 lean closely against the inner surface of end cover 2 and makes the free end of handle 112 stretch out of the other side of protruding portion 22 of end cover 2. Under ordinary condition, two surfaces of slot portion 114 of tooth-shaped shaft 11, the tooth top surface of sector-shaped teeth 113 of moving seat 3 and the inclined surface 315 have the same angle., so the protruding toothed portion 312 is also complementary with sector-shaped teeth 113 into 180°. In this way, when the handle 112 of tooth-shaped shaft 11 is rotated clockwise, the tooth side of shaft-shaped rack 111 and the tooth top of protruding toothed portion 312 of the moving seat 3 are located on a same level, i.e. the shaft-shaped rack 111 and the protruding toothed portion 312 are in the disengagement state, so the mounting plate 1 can move forward and backward with respect to the moving seat 3, as shown in FIG. 3. When the handle 112 is rotated back to its original position counterclockwise, the teeth of shaft-shaped rack 111 and protruding toothed portion 312 are engaged, so the mounting plate 1 and moving seat 3 are then relatively fixed and locked, i.e. the mounting plate 1 can not move forward and backward as shown in FIG. 4. One end of the tensible spring 15 is fixed on the handle 112 of tooth-shaped shaft 11 and the other end is fixed on the lower surface of mounting plate 1 to make the tooth-shaped shaft 11 incline to the shaft-shaped rack 111 and to bring the tooth-shaped shaft 11 engage with the protruding toothed portion 312 under the stretch of tensible spring 15. It shows that the mounting plate 1 before being moved forward and backward is always in a normal locking position, only when the handle 112 is pulled or pushed, the engagement of the shaft-shaped rack 111 and protruding toothed portion 312 is released, the mounting plate 1 can then be made to move forward and backward with respect to the moving seat 3. Once the handle 112 is set to be free, the locking will then be actuated. It shows that this forward and backward moving has an automatic positioning function depending on the tooth distance. The shaft-shaped rack 111 has a length above 160 mm. Correspondingly the minimum distance of the forward and backward moving of the mounting plate 1 is about 10 mm and the maximum moving distance is about 150 mm.

In addition, the present chair device comprises further a locking hook 16 of which has a right-angled fitting portion 160 with a hole located at the upper portion, a hook-shaped clamping portion 162 located at the lower portion, and a corrugated pushing/pulling portion 161 all joined together. The locking hook 16 is fixed on the moving seat 3 by bolts through the fitting portion 160 to make the front end of clamping portion 162 lean closely to the lower end of moving seat 3 and toothed sleeve 4. Such that, even if the support tube 4 is dismantled, the moving seat 3 and the toothed sleeve 5 are still kept to be assembled together.

We claim:

1. A sliding and swiveling device, comprising:

a support tube;

a mounting plate having symmetrical, longitudinally extending sliding slots on two opposite sides thereof, each slot being formed by a flange extending downward and inward at a right angle;

an end cover fitted on one of two opposing ends of said mounting plate;

a moving seat including:

an upper plate with an opening, and an inner annular toothed portion having a series of rectangular teeth provided around the opening, said upper plate being movably inserted in said sliding slots to position said moving seat under said mounting plate; and a holding tube integral with said upper plate and located under said upper plate, the holding tube having a tube hole in communication with the opening of said upper plate; and a rotating assembly comprising:

a short toothed sleeve fixed to said support tube and having an opening; an annular toothed portion with a series of straight teeth provided around the opening of said sleeve and on an inner peripheral face of said sleeve; a protruding inner ring on the inner peripheral face and under the annular toothed portion; and 2 to 4 uniformly distributed cylinders on an upper surface of said protruding inner ring, said toothed sleeve being rotatably inserted into said holding tube of said moving seat;

a movable toothed ring including an upper annular toothed portion having an outer peripheral face and a plurality of straight teeth on the outer peripheral face; a lower circular ring portion integrally formed with and located under said upper annular toothed portion; and a radial recess on an upper surface of said upper annular toothed portion, said radial recess having a bottom face with a long strip-shaped protruding pillar thereon, said movable toothed ring being fitted in the opening of said upper plate and the opening of said toothed sleeve;

2 to 4 coil springs, each being individually placed in a respective cylinder of said toothed sleeve, said coil springs being located between said protruding inner ring of said fixed toothed sleeve and a bottom face of said upper annular toothed portion of said movable toothed ring;

a first, long strip-shaped protruding strip having a semi-circular slot, and being disposed on a middle position of a rear face of said mounting plate in a lengthwise direction opposite to the recess of said movable toothed ring; and a cam shaft having a shaft lever, and a handle fitted to one end of said shaft lever using a connecting rod, said shaft lever being provided with an axially-extending right-angle slot on an outer peripheral face, said shaft lever being rotatably fitted in the first protruding strip, said coil springs urging said movable toothed ring to cause a right angle wall of said protruding pillar to mesh with the right-angle slot, and to simultaneously make said upper annular toothed portion of said movable toothed ring mesh with said teeth of said inner annular toothed portion of said moving seat, thereby allowing said movable toothed ring to be rotatable relative to said toothed sleeve and to said support tube; wherein when said camshaft is rotated, an edge of the right-angle slot on said shaft lever presses said protruding pillar downward and said movable toothed ring downward, and simultaneously causes said teeth of said upper annular toothed portion of said movable toothed ring to mesh with said teeth of said toothed sleeve and said moving seat, thereby rotatably fixing said movable toothed ring to said support tube via said toothed sleeve.

2. The sliding and swiveling device according to claim 1, wherein said upper annular toothed portion of said movable toothed ring, said inner annular toothed portion of said moving seat, and said upper annular toothed portion of said toothed sleeve are each provided with 12 straight teeth.

3. The sliding and swiveling device according to claim 1, wherein said moving seat further includes a protruding toothed portion comprised of a row of protruding teeth on an upper surface of said upper plate, each of said protruding teeth having an inclined face; further comprising:

a moving assembly, including:

a second, long strip-shaped protruding strip having a semi-circular slot, and being fixed to the rear face of said mounting plate so as to be parallel to said first protruding strip, said second protruding strip linearly opposing said protruding toothed portion;

a tooth-shaped shaft including a shaft-shaped rack, and a handle fitted to one end of said shaft using a connecting rod, said shaft-shaped rack having an obtuse-angle slot portion on an outer peripheral face thereof, and that extends in an axial direction, said shaft-shaped rack further having a row of spaced teeth, said shaft-shaped rack being fitted in the second protruding strip, wherein when said tooth-shaped shaft is rotated clockwise, the teeth of said rack and the inclined face of said protruding teeth of said moving seat are parallel to each other, allowing said moving seat to be slid relative to said mounting plate, and wherein when said tooth-shaped shaft is rotated in a counterclockwise rotation, the teeth of said rack and said protruding teeth of said moving seat mesh to lock said moving seat to said mounting plate; and a tension spring having one end fixed on said handle of tooth-shaped shaft, and another end fixed on the rear face of said mounting plate.

4. The sliding and swiveling device according to claim 1, wherein each of four corners of said upper plate of said moving seat are provided with a wheel frame portion, said moving seat further comprises four small wheels, each being individually rotatably fitted in a respective wheel frame portion using a wheel shaft, said moving seat being movably inserted into the sliding slots of said mounting plate by utilizing the four small wheels.

5. The sliding and swiveling device according to claim 1, further comprising a lockup hook having a right-angle fitting portion located at an upper portion thereof; a hook-shaped clamping portion located at a lower portion thereof, and a corrugated push-pull portion joining the fitting portion and clamping portion, the lockup hook being fixed to said moving seat via the fitting portion, so as to cause the clamping portion to be tightly located at a lower end of said moving seat and said toothed sleeve.

6. The sliding and swiveling device according to claim 1, wherein opposite walls of said support tube and said toothed sleeve are provided with mutually matching concave and convex slots to allow said support tube to be fixed to said toothed sleeve.

7. The sliding and swiveling device according to claim 1, wherein said movable toothed ring is comprised of plastic.

8. The sliding and swiveling device according to claim 1, wherein said toothed sleeve is comprised of nylon.

9. The sliding and swiveling device according to claim 1, wherein said moving seat and said support tube are comprised of aluminum alloy.

* * * * *